US006601618B2

(12) United States Patent
Tsukano et al.

(10) Patent No.: US 6,601,618 B2
(45) Date of Patent: Aug. 5, 2003

(54) FILLING APPARATUS AND FILLING METHOD THEREFOR

(75) Inventors: Kenichi Tsukano, Ishikawa-Ken (JP); Masaaki Eda, Ishikawa-Ken (JP); Shinya Kamori, Ishikawa-Ken (JP); Katsunori Tanikawa, Ishikawa-Ken (JP)

(73) Assignee: Shibuya Kogyo Co., Ltd., Kanazawa (JP)

( * ) Notice: Subject to any disclaimer, the term of this patent is extended or adjusted under 35 U.S.C. 154(b) by 0 days.

(21) Appl. No.: 10/090,382

(22) Filed: Mar. 4, 2002

(65) Prior Publication Data

US 2002/0179177 A1 Dec. 5, 2002

(30) Foreign Application Priority Data

May 31, 2001 (JP) ..... 2001-165928

(51) Int. Cl.[7] ..... B67C 3/06

(52) U.S. Cl. ..... 141/45; 141/39; 141/47; 141/54; 141/290; 141/308

(58) Field of Search ..... 141/39–41, 44–50, 141/54, 57, 290, 302, 308

(56) References Cited

U.S. PATENT DOCUMENTS 5,000,234 A * 3/1991 Weiss ..... 141/6

5,501,253 A * 3/1996 Weiss ..... 141/40

FOREIGN PATENT DOCUMENTS

JP 11-342 994 12/1999

* cited by examiner

*Primary Examiner*—J. Casimer Jacyna
(74) *Attorney, Agent, or Firm*—Flynn, Thiel, Boutell & Tanis, P.C.

(57) ABSTRACT

A filling apparatus 1 is made up of a gas passage 14 connected to a storage tank 31 via a connection passage 14*a*, a first gas valve 35 that opens and closes the gas passage, a pressure gas passage 41 connected to a pressure gas supply source, a pressure gas valve 42 that opens and closes the pressure gas passage, an exhaust passage 43 that allows an interior of a container 4 to communicate with the exterior thereof, and an exhaust valve 44 that opens and closes the exhaust passage. With this filling apparatus, before a pressurized filling operation, both the gas passage and the pressure gas passage are opened to pressurize the interior of the container with a carbonated gas supplied through both passages. Further, also before a unpressurized filling operation, both the gas passage and the pressure gas passage are opened to perform a flushing operation in which droplets are discharged from the gas passage with air exhausted from the container into the storage tank via the gas passage. Then, after the filling operation, both the gas passage and the exhaust passage are opened to discharge a certain amount of filling liquid remaining in the gas passage, into the container.

7 Claims, 3 Drawing Sheets

FILLING APPARATUS AND FILLING METHOD THEREFOR

FIELD OF THE INVENTION

The present invention relates to a pressurized filling apparatus for filling a container with a filling liquid such as a carbonated drink, and more specifically, to a filling apparatus for filling a container with a filling liquid such as a non-carbonated drink that can also be used for unpressurized filling and a filling method therefor.

DESCRIPTION OF THE PRIOR ART

A well-known pressurized filling apparatus that fills a container with a filling liquid such as a carbonated drink accommodates a filling liquid in a storage tank together with a pressurized carbonated gas, supplies the carbonated gas in the storage tank to the interior of a sealed container via a gas passage formed in a filling valve and pressurizes the interior of the container, opens the filling valve to start a filling operation when the pressure in the container becomes equal to that in the storage tank, ends the filling operation once the filled amount reaches a predetermined value, and stops applying pressure to the interior of the container and then unseal the container. Further, Japanese Patent Laid-Open No. 11-342994 discloses an unpressurized filling method of using such a pressurized filling apparatus to allow the storage tank to communicate with the atmosphere to fill the container with a non-carbonated drink.

If the above described pressurized filling apparatus is used for an unpressurized filling operation, the following problems may occur: First, in the unpressurized filling operation, a filling liquid may be heated and sterilized, so that it may be filled into a container while hot. With the pressurized filling apparatus, since the container is sealed, the filling operation must be performed while exhausting air from the container via the gas passage formed in the filling valve. However, hot steam from the hot filling apparatus may flow into the gas passage and may be cooled and condensed there, so that the diameter of the passage may be reduced to make the exhaust inefficient, thereby increasing the time required for the filling operation. Further, in a pressurized filling operation, the interior of the container is pressurized to slightly expand the container, so that the level of the liquid after the filling operation is slightly lower than that prior to the pressurization. On the other hand, in the unpressurized filling operation, the interior of the container is not pressurized, so that if the same amount of fluid as that in the pressurized filling operation is filled into the container, then the filling liquid may reach the tip of the gas passage inserted into the container and enter the gas passage. Accordingly, the entered filling liquid must be removed before the next container is filled with the filling liquid.

To solve these problems, the above mentioned Japanese Patent Laid-Open No. 11-342994 provides an auxiliary gas chamber such that in the unpressurized filling operation, a low pressure gas from the auxiliary gas chamber is fed into the gas passage before the operation to drop a bubble-like liquid remaining in the gas passage, into the container. This solves all the above-described problems. However, the auxiliary gas chamber is used only for the unpressurized filling operation and is unnecessary for the pressurized filling operation. Further, no problem occurs if the filling liquid does not enter the gas passage, but if it does due to the large amount of the fluid, then a certain amount of the filling liquid to be filled into the container during the current filling operation is dropped during the next operation, causing an inaccurate amount of filling liquid to be filled into the container.

SUMMARY OF THE INVENTION

Thus, a first aspect of the present invention is a filling apparatus comprising a storage tank having a gas space in an upper part thereof to store filling liquid therein, a filling valve having a liquid passage to which the filling liquid is supplied and a valve element that opens and closes the liquid passage to fill a container with the filling liquid, a gas passage formed in the filling valve, a connection passage that connects the gas space in the storage tank to the gas passage, a gas valve provided in the connection passage to open and close the connection passage, seal means for sealing the container while the liquid passage and the gas passage are in communication with the container, an exhaust passage that allows an interior of the sealed container to communicate with an exterior thereof, an exhaust valve that opens and closes the exhaust passage, and filled amount detecting means for detecting the amount of filling liquid filled into the container, the apparatus sealing the container, then opening the liquid passage to start a filling operation, and closing the liquid passage to end the filling operation once a signal from the filled amount detecting means indicates that the amount of filling liquid filled into the container has reached a predetermined value, wherein the apparatus is provided with a pressure gas passage through which pressure gas is supplied to the sealed container, a pressure gas valve that opens and closes the pressure gas passage, and a pressure gas source that supplies pressure gas to the pressure gas passage so that both the connection passage and the pressure gas passage are open after the container has been sealed and before the fluid channel is closed.

Further, a second aspect of the present invention is a filling method for a filling apparatus comprising a storage tank having a pressure gas space in an upper part thereof to store filling liquid therein, a filling valve having a liquid passage and a gas passage to fill a container with the filling liquid, seal means for sealing the container, and filled amount detecting means for detecting the amount of filling liquid filled into the container, the apparatus filling the sealed container with a predetermined amount of filling liquid, the method comprising:

providing a pressure gas passage through which pressure gas is supplied to the sealed container, and a pressure gas source that supplies pressure gas to the pressure gas passage, sealing the container using the seal means, then supplying gas in the storage tank to the container via the gas passage in the filling valve, supplying the pressure gas from the pressure gas passage to the container, thereby making a pressure in the container equal to that of the gas in the storage tank, subsequently opening the filling valve to start a filling operation, continuing the filling operation while exhausting gas from the container via the gas passage, and closing the filling valve to end the filling operation once a signal from the filled amount detecting means indicates that the amount of filling liquid filled into the container has reached a predetermined value.

Furthermore, a third aspect of the present invention is a filling method for a filling apparatus comprising a storage tank having a gas space in an upper part thereof to store a filling liquid therein, a filling valve having a liquid passage and a gas passage to fill a container with the filling liquid, a connection passage connected to the gas passage, seal means for sealing the container, an exhaust passage that allows an interior of the sealed container to communicate with an exterior thereof, and filled amount detecting means for detecting the amount of filling liquid filled into the container, the apparatus filling the sealed container with a predetermined amount of filling liquid, the method comprising:

providing a pressure gas passage through which a V pressure gas is supplied to the sealed container, and a pressure gas source that supplies pressure gas to the pressure gas passage, sealing the container using the seal means, then supplying the pressure fluid from the pressure gas passage to the container, allowing the pressure gas to flow through the gas passage and connection passage via the container to discharge droplets adhering to inner surfaces of the gas and connection passages, subsequently opening the filling valve to start a filling operation, continuing the filling operation while exhausting gas from the container via the gas passage, and closing the filling valve to end the filling operation once a signal from the filled amount detecting means indicates that the amount of filling liquid filled into the container has reached a predetermined value.

According to the construction of the first aspect of the present invention, for a pressurized filling operation, both the gas passage connected to the storage tank and the pressure gas passage connected to the pressure gas source are opened so that gases supplied through both passages can be used to pressurize the interior of the container. Consequently, compared to the prior art in which only the gas supplied through the gas passage connected to the storage tank is used for pressurization, the time required to pressurize the interior of the container can be reduced, and a possible decrease in the concentration of the gas in the storage tank can be restrained.

Further, in an unpressurized filling operation, gas from the pressure gas passage connected to the pressure gas source is supplied to the interior of the container and then flows through the gas passage. Accordingly, droplets condensed in the gas passage can be removed without the use of the construction of an auxiliary gas chamber, which is unnecessary for pressurized filling.

Furthermore, according to the filling method of the second aspect of the present invention, both the gas passage connected to the storage tank and the pressure gas passage connected to the pressure gas source are opened so that gases supplied through both passages can be used to pressurize the interior of the container. Consequently, compared to the prior art in which only the gas supplied through the gas passage connected to the storage tank is used for pressurization, the time required to pressurize the interior of the container can be reduced, and a possible decrease in the concentration of the gas in the storage tank can be restrained.

Moreover, according to the filling method of the third aspect of the present invention, in an unpressurized filling operation, gas from the pressure gas passage connected to the pressure gas source is supplied to the interior of the container and then flows through the gas passage. Accordingly, droplets condensed in the gas passage can be removed without the use of the construction of an auxiliary gas chamber, which is unnecessary for pressurized filling.

Above and other objects, features and advantages of the present invention will become apparent from the following detailed description of an embodiment thereof with reference to the attached drawings.

DETAILED DESCRIPTION OF THE EMBODIMENTS

Figure 1:
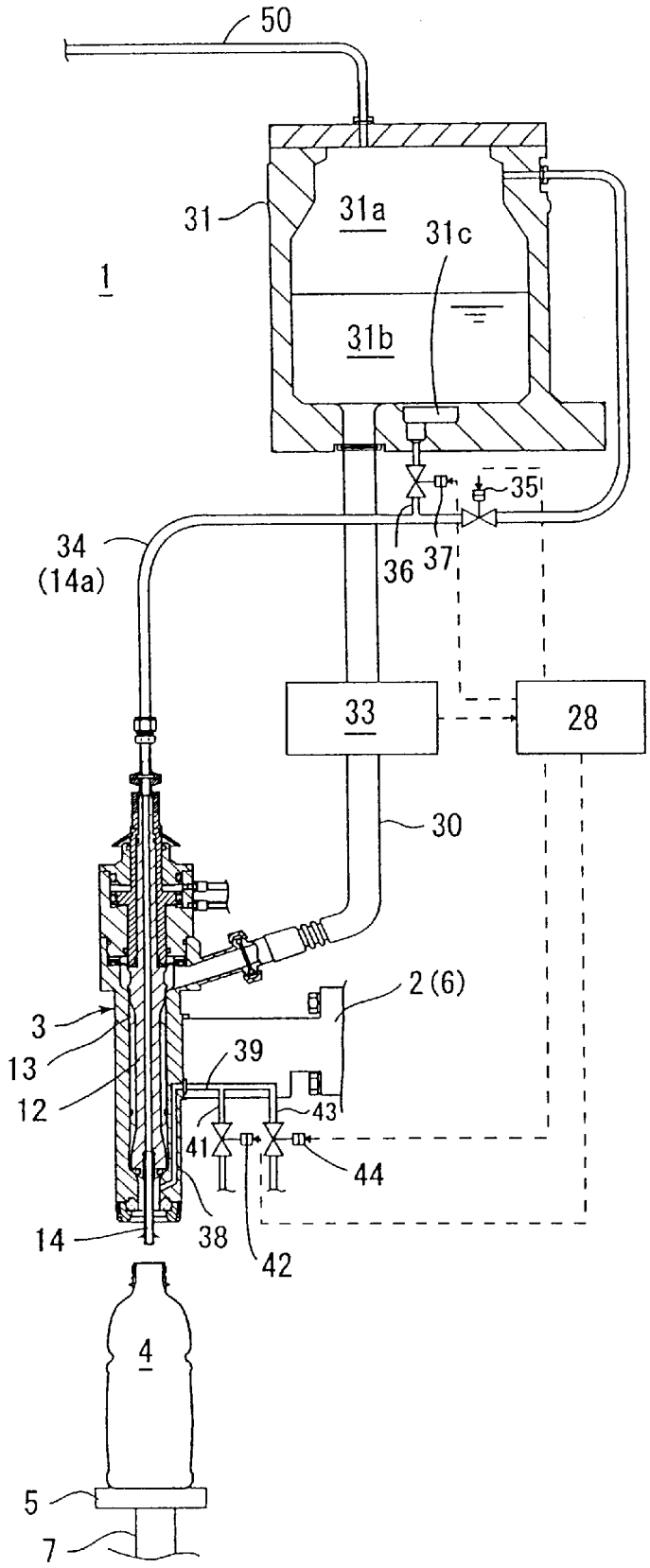
FIG. 1 is a sectional view of a filling apparatus 1 according to an embodiment of the present invention.

The present invention will be described in connection with the illustrated embodiments. In FIG. 1, reference numeral 1 denotes a rotary filling apparatus to which the present invention has been applied. The rotary filling apparatus 1 comprises a rotating member 2 (partially illustrated) rotated by drive means (not shown), ring-shaped storage tanks 31 provided above the rotating member 2 to store filling liquid therein, filling valves 3 provided below the respective storage tanks 31 at respective circumferential positions equally spaced from the corresponding storage tanks 31, in order to carry out filling of liquid, and a table 5 provided below the filling valve 3 and on which a container 4 is placed.

The storage tank 31 stores filling liquid 31*b* with a gas space 31*a*. Further, the filling valves 3 are each attached to an upper plate 6 of the rotating member 2 so as to extend downward, whereas the table 5 is attached to a piston rod 7 (only the piston rod is illustrated) of a cylinder mechanism as an elevating and lowering mechanism provided on a lower plate (not shown) of the rotating member 2 so that the table 5 is elevated and lowered by the elevating and lowering mechanism.

The elevating and lowering mechanism is not limited to the cylinder mechanism but may be a cam mechanism.

Figure 2:
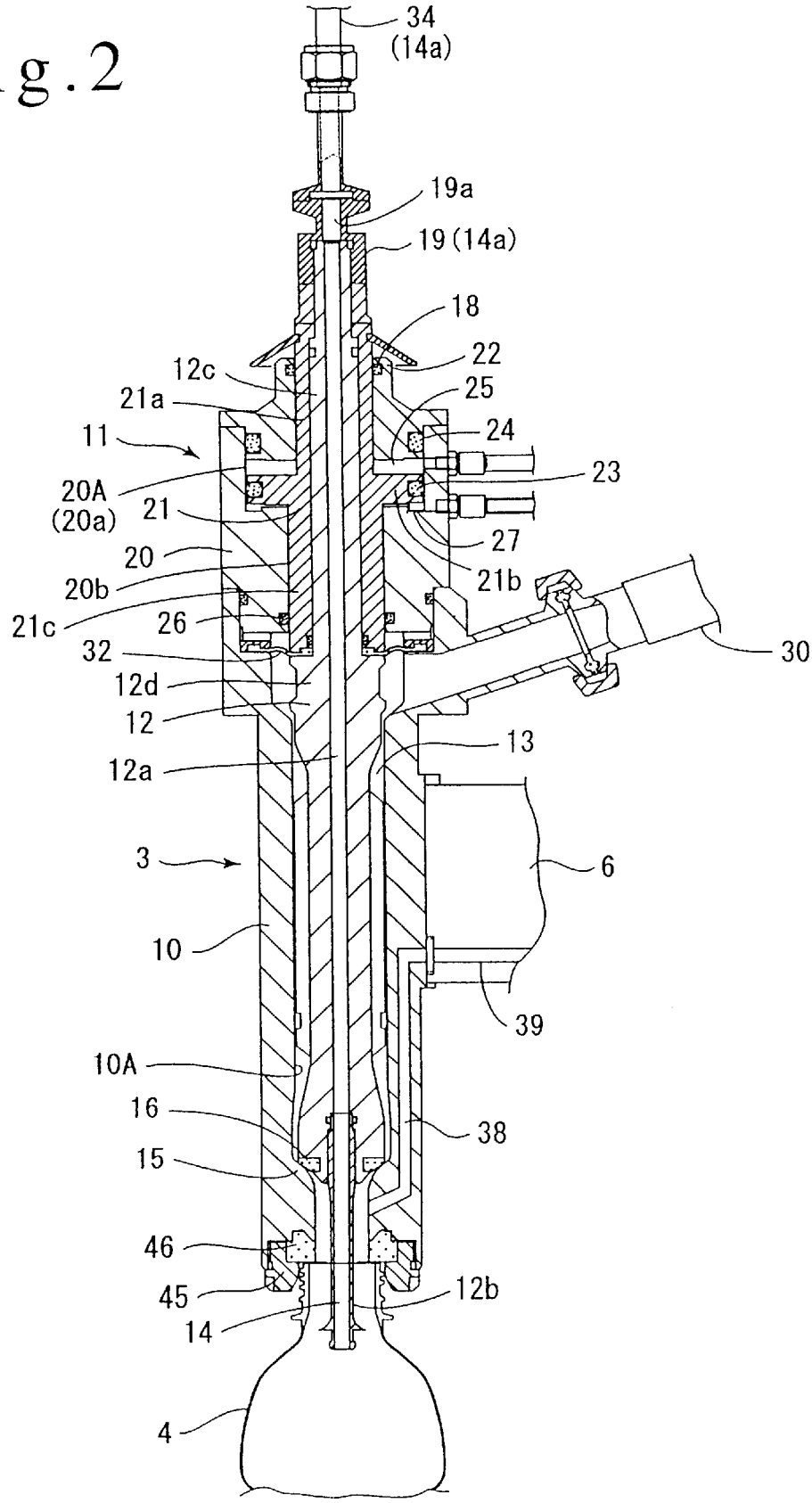
FIG. 2 is an enlarged sectional view of a filling valve 3.

As shown in FIG. 2, the filling valves 3 each comprise a generally cylindrical housing 10 connected to the upper plate 6, a hollow valve rod 12 provided in a staged hole 10A in the housing 10 so as to elevate and lower by a cylinder mechanism 11 described below, a liquid passage 13 formed between the outer periphery of the valve rod 12 and the inner periphery of the housing 10, and a through hole 12*a* corresponding to a hollow portion of the valve rod 12 and constituting a gas passage 14. The staged portion of the staged hole 10A in the housing 10 constitutes a valve seat 15, and the tip of the valve rod 12 has an increased diameter and a ring-shaped seal member is attached to the tip to constitute a valve element 16. The liquid passage 13 can be opened and closed by separating the valve element 16 from the valve seat 15 and contacting the valve element 16 with the valve seat 15, respectively. Further, a pipe 12*b* is attached to the tip of the valve element 16 to extend the gas passage 14.

The cylinder mechanism 11 comprises a generally cylindrical cylinder housing 20 connected to the upper end of the housing 10, a staged hole 20A formed inside the cylinder housing 20, and a generally cylindrical piston 21 slidably fitted in a larger- and smaller-diameter portions 20*a* and 20*b* of the staged hole 20A located in the upper and lower part thereof so as to keep the staged hole 20A air tight. The piston 21 penetrates the smaller-diameter portion 12*c* of the valve rod 12 and is sandwiched between a joint 19 attached to the tip of the smaller-diameter portion 12*c* and the larger-diameter portion 12*d* connected to the lower end of the smaller-diameter portion 12*c*. The piston 21 is also integrated with the valve rod 12.

Further, the upper end of the smaller-diameter portion 21*a* of the piston 21 slidably penetrates a cover 22 sealing the upper end of the cylinder housing 20 to protrude upward. A seal member 18 provided on the inner peripheral surface of the cover 22 seals the cover 22 and the smaller-diameter portion 21*a* of the piston 21.

A closed space is formed among a seal member 18, a seal member 23 provided around the outer periphery of the larger-diameter portion 21*b* of the piston 21 to seal the piston 21 and the larger-diameter portion 20*a* of the cylinder housing 20, and a seal member 24 provided on the outer peripheral surface of the cover 22 to seal the cover 22 and the cylinder housing 20. This space constitutes a first pressure chamber 25 which is in communication with a pressure fluid source via a selector valve (not shown).

A seal member 26 provided on the smaller-diameter portion 20*b* of the cylinder housing 20 to seal the smaller-diameter portion 20*b* and an intermediate diameter portion 21*c* of the piston 21 has a closed space formed between the seal member 23 and the seal member 26. This space constitutes a second pressure chamber 27 which is in communication with the pressure fluid source via a selector valve (not shown).

Thus, if the first pressure chamber 25, located above, is in communication with the pressure fluid source and the second pressure chamber 27, located below, is in communication with the atmosphere, then the piston 21 and the valve rod 12 lower, and the valve element 16 is seated on the valve seat 15 to close the liquid passage 13.

On the other hand, if the first pressure chamber 25, located above, is in communication with the atmosphere and the second pressure chamber 27, located below, is in communication with the pressure fluid source, then the piston 21 and the valve rod 12 elevate, and the valve element 16 is separated from the valve seat 15 to open the liquid passage 13.

Both of the above mentioned selector valves are switched and controlled by a control device 28, described later in detail.

Furthermore, as shown in FIG. 2, the housing 10 has a guide cone 45 provided at the lower end thereof to guide a mouth of the container 4, and the housing 10 has a seal member 46 provided at the lower end thereof, which corresponds to the inner peripheral side of the guide cone 45 enclosing the liquid passage 13.

Thus, by elevating the table 5 to bring the container 4 into tight contact with the seal member 46, the mouth of the container 4 can be sealed with the liquid passage 13 and the gas passage 14 in communication with the interior of the container 4. These components constitute seal means.

The liquid passage 13, formed between the housing 10 and the valve rod 12, is connected to the bottom surface of the storage tank 31 via a fluid supply pipe 30 connected to the housing 10 so that filling liquid is supplied to the liquid passage 13 via the fluid supply pipe 30.

Further, an inner peripheral portion of a diaphragm 32 is held liquid-tight between the valve rod 12 and the piston 21, whereas an outer peripheral portion of the diaphragm 32 is held liquid-tight between the housing 10 and the cylinder housing 20.

The fluid supply pipe 30 is provided with a flow meter 33 as a filled amount detecting means for measuring the flow rate of filling liquid so that a value detected by the flow meter 33 is inputted to the control device 28.

In this regard, the filled amount detecting means is not limited to the flow meter 33 but may be a level sensor and so forth.

The joint 19 has a through hole 19*a* formed therein and which is in communication with the through hole 12*a* in the valve rod 12 and which has the same diameter as the through hole 12*a*. The joint 19 further has one end of a gas tube 34 connected to its upper end, with the other end of the gas tube 34 connected to the gas space 31*a* in the storage tank 31. The gas tube 34 and the joint 19 constitute a connection passage 14*a*.

The gas tube 34 is composed of a flexible hose and can thus move in response to the elevating and lowering of the valve rod 12.

As shown in FIG. 1, the gas tube 34 has a first gas valve 35 provided in the middle of the gas tube 34 and controlled by the control device 28 to be opened and closed. When the first gas valve 35 is open, the storage tank 31 is in communication with the container 4 via the gas passage 14. When the first gas valve 35 is closed, the communication is precluded at the position of the first gas valve 35.

Further, the first gas valve 35 has a branched passage 36 connected thereto downstream thereof and which is in communication with an exhaust manifold 31*c* formed at the bottom of the storage tank 31. The branched passage 36 has a second exhaust valve 37 provided in the middle thereof and controlled by the control device 28 to be opened and closed.

Furthermore, the housing 10 has a communication passage 38 formed at a lower position thereof and opened into the liquid passage 13 below the valve seat 15. The communication passage 38 has a communication pipe 39 provided in the upper plate 6.

Figure 3:
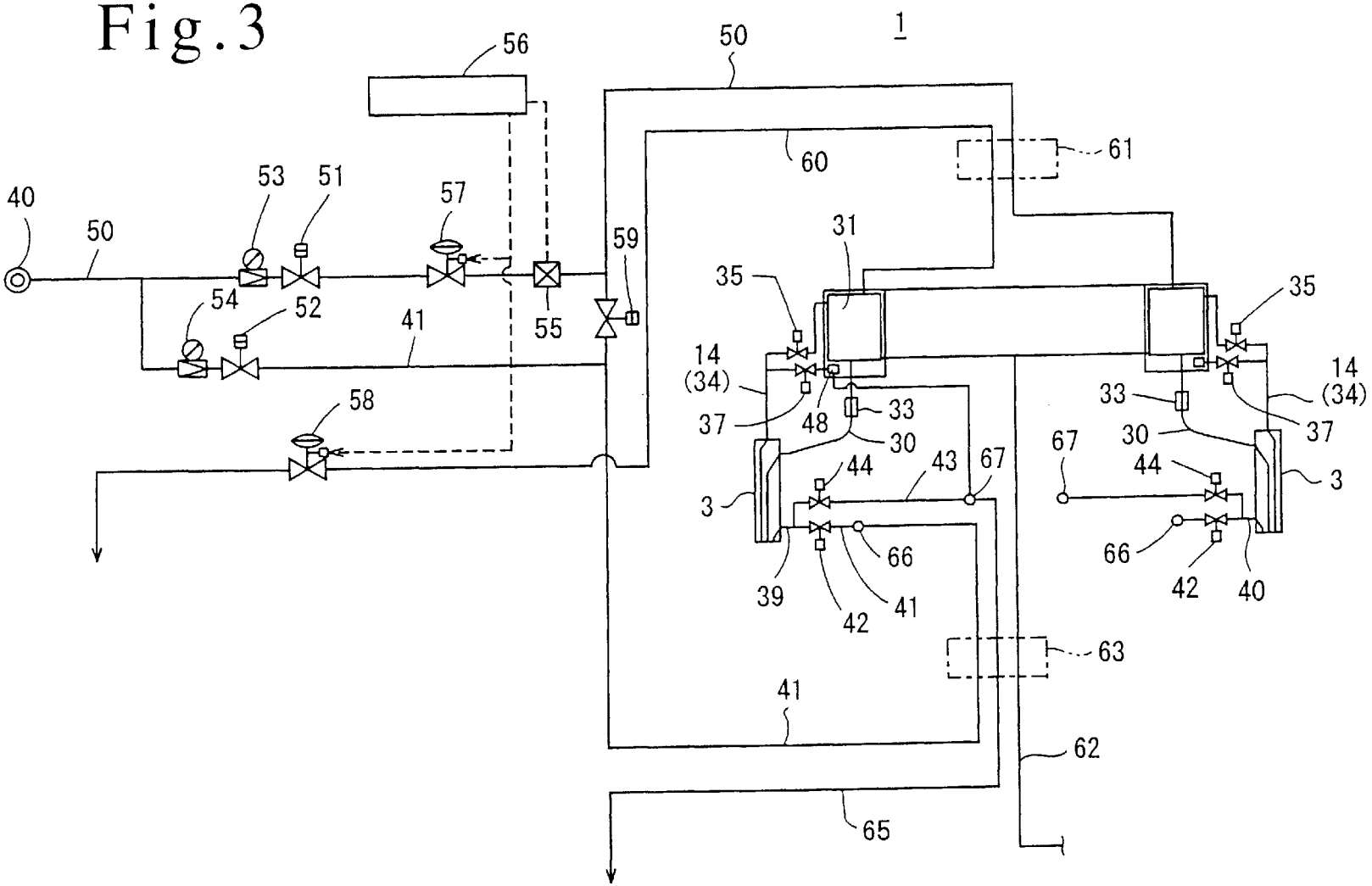
FIG. 3 is a system diagram of the filling apparatus 1.

As shown in FIG. 3, the communication pipe 39 has a pressure gas passage 41 and an exhaust passage 43 connected thereto. The pressure gas passage 41 is in communication with the pressure gas source 40 via a manifold 66, and the exhaust passage 43 is in communication with the exterior via a pressure gas passage 41 and a manifold 67.

The pressure gas passage 41 has a pressure gas valve 42 controlled by the control device 28 to be opened and closed. When the pressure gas valve 42 is open, the pressure gas source 40 is in communication with the container 4 via the pressure gas passage 41. When the pressure gas valve 42 is closed, the communication between the pressure gas source 40 and the container 4 is interrupted at the position of the pressure gas valve 42.

Further, the exhaust passage 43 has an exhaust valve 44 controlled by the control device 28 to be opened and closed. When the exhaust valve 44 is open, the container 4 is in communication with the exterior via the exhaust passage 43. When the exhaust valve 44 is closed, the communication between the container 4 and the exterior is interrupted at the position of the exhaust valve 44.

As shown in FIG. 3, the storage tank 31 has a first gas supply passage 50 and a first external passage 60 connected to the top thereof via a rotary joint 61. The first gas supply passage 50 is connected to the pressure gas source 40, and the first external passage 60 is in communication with the exterior. The storage tank 31 also has a fluid supply passage 62 connected thereto via a rotary joint 63.

The first gas supply passage 50 is provided with a first regulator 53 and a first opening and closing valve 51 located below the first regulator 53. A first control valve 57 and a pressure sensor 55 are provided downstream of the first control valve 57. The first control valve 57 has its valve opening adjusted by an indication controller 56, and the pressure sensor 55 measures the pressure in the first gas supply passage 50. Further, the first external passage 60 is provided with a second control valve 58 having its valve opening adjusted by the indication controller 56.

Furthermore, the manifold 66 is connected with the first gas supply passage 50 upstream of the first regulator 53 by the pressure gas passage 41 via a rotary joint 63. The manifold 67 having the exhaust passage 43 connected thereto is in communication with the exterior through a second external passage 65 via the rotary joint 63.

Further, the pressure gas passage 41 has a second regulator 54 and a second opening and closing valve 52 provided downstream of the second regulator 54. The downstream side of the second opening and closing valve 52 and the downstream side of the pressure sensor 55 in the first gas supply passage 50 are connected together with a third opening and closing valve 59.

Description of Operation during Pressurized Filing

For a pressurized filling operation of filling a container with a filling liquid such as carbonated drink, the pressure gas source 40 supplies a carbonated gas, the control device 28 closes the second gas valve 52, and the first gas valve 51 and the third gas valve 59 are opened to supply the pressurized carbonated gas to the storage tank 31 and pressure gas passage 41. Further, the indication controller 56 properly adjusts the valve opening of the first control valve 57 and second control valve 58 according to a measured value from the pressure sensor 55, to maintain the pressure in the storage tank 31 at a predetermined value. On the other hand, a carbonated gas of the same pressure is supplied to the pressure gas passage 41. In this embodiment, the value set in the first regulator 53 is 0.5 MPa, and the indication controller 56 maintains 0.4 MPa.

When the container 4 is supplied via a supply star wheel to the table 5 of the filling apparatus 1 set as described above, the elevating and lowering mechanism elevates the table 5. Then, the pipe 12*b* at the tip of the valve rod 12 is inserted into the mouth of the container 4, and the mouth of the container 4 is brought into pressure contact with the seal member 46 to seal the container 4.

Subsequently, the control device 28 opens both the first gas valve 35 and the pressure gas valve 42, which have been closed, and supplies a carbonated gas to the interior of the container 4 via both the gas passage 14 and the pressure gas passage 41 so that the pressure of the carbonated gas is the same as the pressure (0.4 MPa) of the gas in the storage tank 31*a* (pressuring step).

Then, when the rotating member 2 is further rotated to transfer the container 4 to its filling start position, the control device 28 closes the pressure gas valve 42, and causes the cylinder mechanism 11 to elevate the valve element 16 to open the liquid passage 13 in order to start a filling operation (filling step). During the filling operation, the carbonated gas in the container 4 is exhausted to the gas space 31*a* in the storage tank 31 via the gas passage 14 and the connection passage 14*a*. Further, during the operation, the control device 28 continuously monitors the flow rate input by each flow meter 33, and if a predetermined supplied amount is reached, the cylinder mechanism 11 is operated to lower the valve element 16.

Thus, the liquid passage 13 is closed to end the filling operation. At this time, the filling liquid is stopped below the pipe 12*b* at the tip of the valve rod 12, that is, the opening of the gas passage 14.

Then, after the first gas valve 35 has been closed, the control device 28 opens the second gas valve 37 and then the exhaust valve 44 to release the pressure in the gas passage 14 and connection passage 14*a* via the branched passage 36 and then release the pressure in the container 4 via the exhaust passage 43 (snifting step).

Subsequently, the table 5 is lowered to its discharge position, where the container 4 is discharged via a discharge star wheel (not shown).

As appreciated from the above description, during the pressurization associated with the pressurized filling operation of this embodiment, the carbonated gas supplied through both the gas passage 14 and the pressure gas passage 41 is used to pressurize the interior of the container, thereby reducing the time required for the pressurization compared to the prior art, with which only the carbonated gas supplied via the gas passage in the filling valve is used to pressurize the interior of the container. Further, the carbonated gas in the storage tank 31 has its concentration gradually reduced by the air in the container 4, which is exhausted during the filling operation. However, a pure carbonated gas is constantly supplied through the pressure gas passage 41 to reduce the speed at which the concentration decreases.

Description of Operation During Unpressurized Filing

For a unpressurized filling operation of filling a container with filling liquid such as a non-carbonated drink, the pressure gas source 40 supplies air, and the control device 28 closes the first gas valve 51 and the third gas valve 59, while opening the second gas valve 52 to supply pressurized air to the pressure air passage 41. In this embodiment, the value set in the second regulator 54 is 0.1 MPa, which is slightly higher than the atmospheric pressure. At this time, the gas space 31*a* in the storage tank 31 is open to the atmosphere via the first external passage 60.

When the container 4 is supplied via the supply star wheel to the table 5 of the filling apparatus 1 set as described above, the elevating and lowering mechanism elevates the table 5. Then, the pipe 12*b* at the tip of the valve rod 12 is inserted into the mouth of the container 4, and the mouth of the container 4 is brought into pressure contact with the seal member 46 to seal the container 4. Subsequently, the control device 28 opens both the first gas valve 35 and the pressure gas valve 42, which have been closed until then, and supplies air to the interior of the container 4 via the pressure gas passage 41, which is in communication with the pressure gas source 40. Thus, the air in the container 4 is exhausted to the storage tank 31 via the gas passage 14 and the connection passage 14*a*, which are in communication with the interior of the container 4 (flushing step).

Thus, the air flowing through the gas passage 14 forces steam emitted from the filling liquid during the last filling operation, into the gas passage 14, where the steam is cooled and condensed. The resulting droplets are discharged to the interior of the storage tank 31.

Then, when the rotating member 2 is further rotated to transfer the container 4 to its filling start position, the control device 28 closes the pressure gas valve 42, and operates the cylinder mechanism 11 to elevate the valve element 16 to open the liquid passage 13 in order to start a filling operation (filling step). During the filling operation, the air in the container 4 is exhausted to the gas space 31*a* in the storage tank 31 via the gas passage 14 and the connection passage 14*a*. Further, during the operation, the control device 28 continuously monitors the flow rate input by each flow meter 33, and if a predetermined supplied amount is reached, the cylinder mechanism 11 is operated to lower the valve element 16.

The liquid passage 13 is thereby closed to end the filling operation. At this time, in the unpressurized filling operation, a certain amount of the metered filling liquid may have entered the gas passage 14 depending on the set filled amount.

Thus, the control device 28 opens the exhaust valve 44 with the first gas valve 35 open, thereby allowing the interior of the container 4 to communicate with the atmosphere via the exhaust valve 43 (communication step).

The filling liquid in the gas passage 14 is thereby dropped into the container 4. Subsequently, the table 5 is lowered, and at the discharge position, the container 4 is discharged via the discharge star wheel (not shown).

As appreciated from the above description, slightly pressurized air from the pressure gas passage 41 is supplied to the container 4 to allow the air in the container 4 to flow through the gas passage 14 and the connection passage 14*a*, thereby discharging the droplets in the passages 14 and 14*a*, into the storage tank 31. Consequently, the flushing operation can be preformed using the same construction as that in the pressurized filling operation. Further, after the filling step, the filling liquid having entered the gas passage 14 during the filling operation is dropped and returned to the container 4, into which the filling liquid is to be filled. Consequently, filling accuracy is improved compared to the prior art.

While the present invention has been described in connection with certain preferred embodiments, it is to be understood that the subject matter encompassed by the present invention includes all alternatives, modifications, and equivalents as can be included within the spirit and scope of the following claims.

What is claimed is:

1. A filling apparatus comprising a storage tank for storing a filling liquid therein and having a gas space in an upper part thereof, a filling valve having a liquid passage for supplying the filling liquid, a valve element for opening and closing the liquid passage and filling a container with the filling liquid, a gas passage provided in the filling valve and communicating with the interior of the container, a connection passage for connecting the gas space in the storage tank with the gas passage, a gas valve provided in the connection passage for opening and closing the connection passage, seal means for sealing the container while the liquid passage and the gas passage are in communication with the container, an exhaust passage for allowing the interior of the sealed container to communicate with the exterior thereof, an exhaust valve for opening and closing the exhaust passage, and filled amount detecting means for detecting the amount of the filling liquid in the container, the apparatus sealing the container and then opening the fluid passage to start a filling operation and closing the fluid channel to end the filling operation in response to a signal from the filled amount detecting means that indicates that the amount of the filling liquid filled into the container has reached a predetermined value, characterized in that the apparatus is provided with a pressure gas passage which is separate from the filling valve gas passage and through which pressure gas is supplied to the sealed container, a pressure gas valve that opens and closes the pressure gas passage, a pressure gas source for supplying pressure gas to the pressure gas passage so that both the connection passage and the pressure gas passage are open during the time after the container has been sealed and before the fluid channel is closed and means for simultaneously and separately supplying pressure gas through the pressure gas passage and filling valve gas passage to the container.

2. The filling apparatus of claim 1, wherein the filling apparatus is used for pressurized filling and, during the pressurized filling, the storage tank is in communication with the pressurized gas source and the storage tank is pressurized with gas from the pressure gas source.

3. The filling apparatus of claim 1, wherein the filling apparatus can be switched from pressurized filling, in which filling is executed with the storage tank being pressurized, to unpressurized filling, in which filling is executed with the storage tank at atmospheric pressure.

4. The filling apparatus of claim 3, wherein during unpressurized filling, both the connection passage and the exhaust passage are opened after the liquid passage has been closed.

5. A method of filling a container comprising the steps of:

providing a filling apparatus comprising a storage tank for storing a filling liquid therein and having a gas space in an upper part thereof, a filling valve having a liquid passage for supplying the filling liquid and a gas passage communicating with the interior of the container, seal means for sealing the container and filled amount detecting means for detecting the amount of the filling liquid filled in the container;

providing said filling apparatus with a pressure gas passage separate from the filling valve gas passage and for supplying pressure gas to the sealed container and a pressure gas supply source for supplying pressure gas to the pressure gas passage;

sealing the container with the seal means;

supplying pressure gas to the container simultaneously and separately from the pressure gas passage and the filling valve gas passage, thereby equalizing the pressure in the container to the gas pressure in the storage tank;

opening the filling valve to commence a filling operation;

continuing the filling operation while exhausting gas from the container via the gas passage; and closing the filling valve to end the filling operation when a signal from the filled amount detecting means indicates that the amount of filling liquid in the container has reached a predetermined value.

6. A method of filling a container comprising the steps of:

providing a filling apparatus comprising a storage tank for storing a filling liquid therein and having a gas space open to the atmosphere in an upper part thereof, a filling valve having a liquid passage for supplying the filling liquid and a gas passage, a connection passage connected to the gas passage, seal means for sealing the container, an exhaust passage allowing the interior of the container to communicate with the exterior thereof and filled amount detecting means for detecting the amount of filling liquid in the container;

providing said filling apparatus with a pressure gas passage for supplying pressure gas to the sealed container and a pressure gas supply source for supplying pressure gas to the pressure gas passage;

sealing the container with the seal means;

supplying pressure gas from the pressure gas passage to the container;

allowing the pressure gas to flow through the filling valve gas passage and connection passage via the container to discharge droplets adhering to inner surfaces of the filling valve gas and connection passages;

opening the filling valve to commence a filling operation;

continuing the filling operation while exhausting gas from the container via the gas passage; and closing the filling valve to end the filling operation when a signal from the filled amount detecting means indicates that the amount of filling liquid in the container has reached a predetermined value.

7. The method of claim 6, additionally comprising the steps of:

allowing the filling valve gas passage and connection passage to communicate with the atmosphere and allowing the interior of the sealed container to communicate with the exterior thereof through the exhaust passage to remove filling liquid having entered the filling valve gas passage during the filling operation and enter the filling liquid into the container.

* * * * *